US010019936B2

(12) United States Patent
Jung et al.

(10) Patent No.: US 10,019,936 B2
(45) Date of Patent: Jul. 10, 2018

(54) ORGANIC LIGHT EMITTING DISPLAY

(71) Applicants: Hae-Goo Jung, Yongin (KR); Do-Hyung Ryu, Yongin (KR)

(72) Inventors: Hae-Goo Jung, Yongin (KR); Do-Hyung Ryu, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 277 days.

(21) Appl. No.: 13/917,080

(22) Filed: Jun. 13, 2013

(65) Prior Publication Data

US 2014/0198133 A1 Jul. 17, 2014

(30) Foreign Application Priority Data

Jan. 11, 2013 (KR) ..... 10-2013-0003497

(51) Int. Cl.
*G09G 3/32* (2016.01)
*G09G 3/3208* (2016.01)

(52) U.S. Cl.
CPC ... *G09G 3/3208* (2013.01); *G09G 2300/0443* (2013.01); *G09G 2320/043* (2013.01)

(58) Field of Classification Search
CPC ..... G09G 3/3208; G09G 2300/0443; G09G 2320/043
USPC ..... 345/76–83, 204–215, 690–699; 315/169.1–169.4; 313/498
See application file for complete search history.

(56) References Cited

U.S. PATENT DOCUMENTS 6,856,328 B2 * 2/2005 Holtslag ..... H04N 5/144 345/63
2002/0122049 A1 * 9/2002 Freidhoff ..... G02F 1/133514 345/694
2003/0052840 A1 * 3/2003 Shannon ..... G09G 3/3258 345/55
2006/0066640 A1 3/2006 Kothari et al.
2006/0240281 A1 * 10/2006 Liao ..... H01L 51/5206 428/690
2006/0267509 A1 * 11/2006 Yang ..... G09G 3/325 315/169.3
2007/0064020 A1 * 3/2007 Credelle ..... G09G 3/2003 345/694
2007/0109468 A1 * 5/2007 Oku ..... G02F 1/133514 349/110
2007/0222800 A1 * 9/2007 Fish et al. ..... 345/694
2008/0252558 A1 * 10/2008 Kim et al. ..... 345/55
2009/0051627 A1 2/2009 Ihata et al.
(Continued)

FOREIGN PATENT DOCUMENTS

JP 2009122652 A * 6/2009
KR 1020040091297 A 10/2004
(Continued)

*Primary Examiner* — Stacy Khoo
(74) *Attorney, Agent, or Firm* — H.C. Park & Associates, PLC

(57) ABSTRACT

There is provided an organic light emitting display that includes a plurality of pixels are arranged in a plurality of rows and columns Each of the pixels includes a plurality of sub pixels. At least one sub pixel of the plurality of sub pixels of at least one pixel is divided into a plurality of divisional sub pixels. Since the divisional sub pixels alternately emit light, it is possible to reduce deterioration speed of the sub pixels, thereby preventing an afterimage from being generated by deterioration of the sub pixels.

19 Claims, 3 Drawing Sheets

(56) References Cited

U.S. PATENT DOCUMENTS

| | | | | |
|---|---|---|---|---|
| 2009/0079351 | A1* | 3/2009 | Choi et al. | 315/169.3 |
| 2009/0315874 | A1 | 12/2009 | Kim | |
| 2011/0267297 | A1* | 11/2011 | Yamazaki et al. | 345/173 |
| 2011/0273482 | A1* | 11/2011 | Massart | G09G 3/20 345/690 |
| 2012/0105496 | A1* | 5/2012 | Komiya | G09G 3/003 345/690 |

FOREIGN PATENT DOCUMENTS

| | | | |
|---|---|---|---|
| KR | 1020060085160 | A | 7/2006 |
| KR | 1020090021080 | A | 2/2009 |
| KR | 10-0952814 | B1 | 4/2010 |
| KR | 1020120023261 | A | 3/2012 |

* cited by examiner

ORGANIC LIGHT EMITTING DISPLAY

CLAIM OF PRIORITY

This application makes reference to, incorporates the same herein, and claims all benefits accruing under 35 U.S.C. § 119 from an application earlier filed in the Korean Intellectual Property Office filed on 11 Jan. 2013 and there duly assigned Serial No. 10-2013-0003497.

BACKGROUND OF THE INVENTION

Field of the Invention

The present invention relates to an organic light emitting display capable of reducing deterioration speed of a pixel.

Description of the Related Art

An organic light emitting diode (OLED) emits light by a difference in energy in a process where holes injected through an anode electrode and electrons injected through a cathode electrode are recombined in an organic light emitting layer. At this time, the emitted light may have different wavelengths, for example, red, green, and blue wavelengths in accordance with the organic light emitting layer. The wavelength of the emitted light is determined by a material (including host material and a dopant material) of the organic light emitting layer.

Since a characteristic of a part of the material of the organic light emitting layer is deteriorated in accordance with atmosphere and emission time, brightness of the light emitted from the OLED is gradually reduced. For example, meanwhile a brightness reduction ratio of an organic light emitting layer that emits light of green wavelength in accordance with time is relatively small, as brightness is rapidly reduced after a time in an organic light emitting layer that emits light of green wavelength. Therefore, due to a difference in the brightness reduction ratio caused by a difference in the characteristics of the materials, a difference in brightness is generated between OLEDs.

In addition, when the same image such as a logo, a time, and subtitles of a broadcaster is continuously displayed at a specific position, deterioration of the OLEDs may be accelerated. Due to deterioration caused by a long-time operation, an afterimage or image sticking may be generated. A spot caused by the afterimage may deteriorate picture quality.

SUMMARY OF THE INVENTION

Accordingly, the present invention has been made to provide an organic light emitting display capable of reducing deterioration speed of an organic light emitting diode (OLED).

The present invention has been also made to provide an organic light emitting display capable of preventing an afterimage from being generated.

According to one aspect of the present invention, there is provided an organic light emitting display that includes a plurality of pixels arranged in a plurality of rows and columns, wherein each of the pixels comprises a plurality of sub pixels, and wherein at least one of the plurality of sub pixels of at least one of the pixels includes a plurality of divisional sub pixels. The plurality of sub pixels may include a red sub pixel, a green sub pixel, and a blue sub pixel, each of the red sub pixel, the green sub pixel, and the blue sub pixel may be divided into a plurality of divisional sub pixels. Each of the red sub pixel, the green sub pixel, and the blue sub pixel may be composed of differing numbers of divisional sub pixels, respectively. The plurality of sub pixels may include a red sub pixel, a green sub pixel, and a blue sub pixel, and only the blue sub pixel may be divided into a plurality of divisional sub pixels.

The divisional sub pixels within one of the sub pixels may alternately emit light. The plurality of divisional sub pixels within any one of the sub pixels may alternately emit light within a frame cycle or a time cycle. The plurality of divisional sub pixels may alternately emit light within a frame cycle or a time cycle corresponding to when accumulated operation time of the organic light emitting display is no less than a predetermined value.

The organic light emitting display device may also include a plurality of scan lines, each being coupled to a plurality of sub pixels in a row; and a plurality of data lines, each being coupled to a plurality of sub pixels in a column. The plurality of divisional sub pixels within a single sub pixel are coupled to the scan lines of different rows, respectively. The plurality of divisional sub pixels within a single sub pixel may be coupled to a same one of the data lines. The organic light emitting display device may also include a scan driver coupled to the plurality of scan lines and a data driver coupled to the plurality of data lines.

A same image is displayed on at least one pixel for a predetermined time. The at least one pixel that includes the sub pixels that include a plurality of divisional sub pixels may be intensively provided in a predetermined region of the plurality of rows and columns. The predetermined region may be a region adjacent to an edge of the plurality of rows and columns. The predetermined region may be a region adjacent to a corner of the plurality of rows and columns.

Ones of the plurality of divisional sub pixels within one of the sub pixels of a pixel may emit light of a same color and may be independently controlled by being connected to a separate signal line. All of the pixels may include at least one sub pixel that includes a plurality of divisional sub pixels that are independently controlled. Only a portion of all of the pixels may include at least one sub pixel that includes a plurality of divisional sub pixels that are independently controlled and emits light of a same color. Each divisional sub pixels within a sub pixel emit light of a same color and are adapted to be driven in an alternate manner. All of the divisional sub pixels within a sub pixel emit a same color of light, and all of the sub pixels within a pixel may emit different color light from each other, and each of the divisional sub pixels within a sub pixel may be independently controlled.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
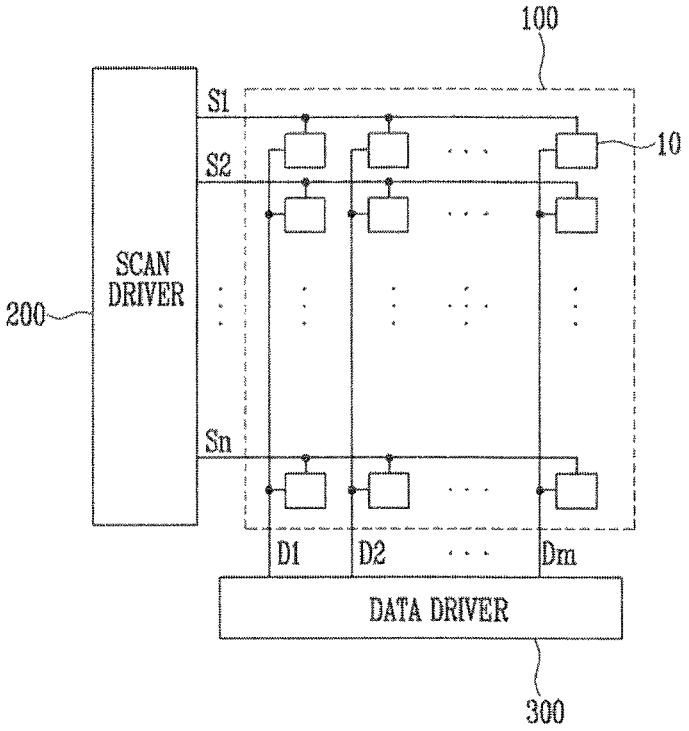
FIG. 1 is a block diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, preferred embodiments of the present invention will be described in detail with reference to the accompanying drawings. The following embodiments are provided so that those skilled in the art may fully understand the present invention and may have various modifications. The scope of the present invention is not limited to the following embodiments.

Turning now to FIG. 1, FIG. 1 is a block diagram illustrating an organic light emitting display according to an embodiment of the present invention. Referring now to FIG. 1, an organic light emitting display according to the embodiment of the present invention includes a display unit 100 in which an image is displayed, a scan driver 200 and a data driver 300 for providing signals to display the image.

The display unit 100 includes a plurality of scan lines S1 to Sn arranged in one direction, for example, in a row direction, data lines D1 to Dm arranged in a direction that intersects the scan lines S1 to Sn, for example, in a column direction, and a plurality of pixels 10 arranged in a matrix at intersections between the scan lines S1 to Sn and the data lines D1 to Dm. The scan driver 200 is coupled to the scan lines S1 to Sn and the data driver 300 is coupled to the data lines D1 to Dm.

Each of the plurality of pixels 10 includes a plurality of sub pixels, for example, a red (R) sub pixel, a green (G) sub pixel, a blue (B) sub pixel, and a white (W) sub pixel. Each of the sub pixels may be formed of an organic light emitting diode (OLED). The OLED includes an anode electrode, an organic light emitting layer, and a cathode electrode. The anode electrode may be coupled to a power supply voltage ELVDD and the cathode electrode may be coupled to a ground voltage ELVSS.

In addition, in at least one pixel 10 or a partial pixel 10 of the plurality of pixels 10, at least one sub pixel of the plurality of sub pixels is divided into a plurality of divisional sub pixels.

Figure 2A:
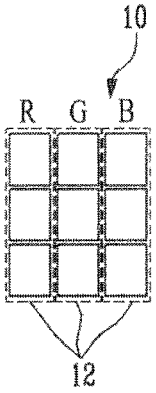
FIGS. 2A to 2C are plan views illustrating an embodiment of the pixel illustrated in FIG. 1 in detail.
Figure 2B:
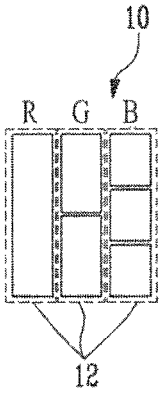
Figure 2C:
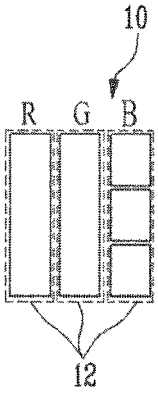

Turning now to FIGS. 2A to 2C, FIGS. 2A to 2C are plan views illustrating in detail an embodiment of a pixel 10 of FIG. 1. Referring now to FIG. 2A, each of a plurality of sub pixels 12 that form one pixel 10 may be divided into a plurality of divisional sub pixels. For example, in FIG. 2A, each of the red (R) sub pixel, the green (G) sub pixel, and the blue (B) sub pixel may be divided into three divisional sub pixels.

Referring now to FIG. 2B, the plurality of sub pixels 12 that form one pixel 10 may be divided into varying numbers of divisional sub pixels, respectively. For example, in FIG. 2B, the red (R) sub pixel is not divided, the green (G) sub pixel is divided into two divisional sub pixels, and the blue (B) sub pixel is divided into three divisional sub pixels.

Referring now to FIG. 2C, only one of the sub pixels 12 that form one pixel 10 may be divided into a plurality of divisional sub pixels. For example, the red (R) sub pixel and the green (G) sub pixel are not divided, but only the green (B) sub pixel may be divided into three divisional sub pixels.

In FIG. 2C, the blue (B) sub pixel is divided into a plurality of divisional sub pixels. For example, a sub pixel having relatively high deterioration speed may be selected to be divided into a plurality of divisional sub pixels in consideration of a deterioration degree in accordance with the material characteristic of an organic light emitting layer of the blue (B) sub pixel.

In each of FIGS. 2A to 2C, each of the divisional sub pixels of a sub pixels 12 that is divided as described above may be adapted to alternately emit light with the remaining divisional sub pixels in any given sub pixel 12.

Figure 3:
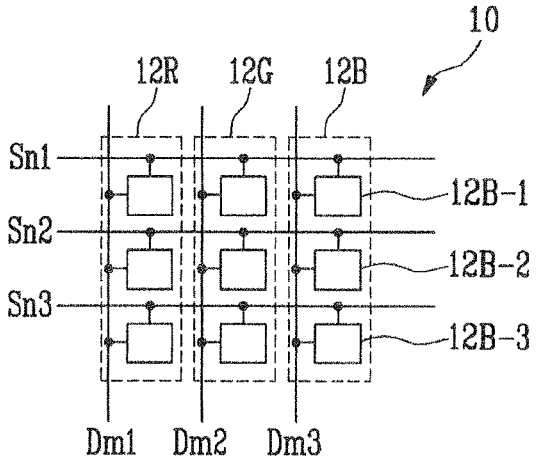
FIG. 3 is a plan view illustrating a coupling structure between sub pixels and scan lines and data lines for alternately emitting light for the pixel of FIG. 2A.

Turning now to FIG. 3, FIG. 3 is a plan view illustrating a coupling structure between divisional sub pixels, scan lines and data lines for alternately emitting light for the pixel arrangement of FIG. 2A. For example, as illustrated in FIG. 2A, when each of a red sub pixel 12R, a green sub pixel 12G, and a blue sub pixel 12B is divided into three divisional sub pixels, the divisional sub pixels of each of the sub pixels 12R, 12G, and 12B are coupled to scan lines Sn1, Sn2, and Sn3 of different rows and data lines Dm1, Dm2, and Dm3 of the same column. Consequently, divisional sub pixels of any one of the sub pixels can be independently controlled in any manner that the designer of the display sees fit. As discussed previously, design considerations can include, but are not limited to, elimination of the image sticking problem of a same image always being displayed, and/or compensation for the fact that some colors of organic light emitting layers deteriorate faster over the life of the display device than other colors.

In the above coupling structure, for example, at least one divisional sub pixel 12B-1 of the blue sub pixel 12B may alternately emit light (i.e. be alternately driven) with the remaining divisional sub pixels 12B-2 and 12B-3 in accordance with a time cycle or a frame cycle. For example, the divisional sub pixel 12B-1 and the divisional sub pixels 12B-2 and 12B-3 may alternately emit light according to a time cycle or a frame cycle, or the divisional sub pixel 12B-1 and the divisional sub pixels 12B-2 and 12B-3 emit light for a time (for example, 300 hours) and, after the time, the divisional sub pixel 12B-1 and the divisional sub pixels 12B-2 and 12B-3 may then alternately emit light in accordance with a time cycle and a frame cycle. The time can be an accumulated operation time or a total operation time of the organic light emitting display, and may be set in consideration of a point of time at which deterioration of the divisional sub pixels starts due to the material characteristics of the organic light emitting layer in that sub pixel.

The OLEDs that form the sub pixels deteriorate over the length of the life of the display due to the material characteristics of the organic light emitting layers. Due to a difference between the materials of the organic light emitting layers in accordance with the different wavelengths of light emitted by each of the sub pixels 12, deterioration rates and degrees of the respective sub pixels vary. Deterioration of the OLED layer having high deterioration speed may be also be accelerated with the increase in emission time, which could be caused when a same image is frequently being displayed.

In conventional organic light emitting displays, since all of the pixels in the display unit have the same structure, when the same image is continuously displayed in a pixel at a specific location, deterioration of the sub pixel at that location is accelerated, so that an afterimage may be generated.

According to the embodiment of the present invention, sub pixels located at a specific location where the same image, such as a logo, the time, and subtitles of a broadcaster is continuously displayed, may be designed to have the structure of the embodiment described in FIGS. 2A, 2B, and 2C. The sub pixels according to the embodiment of the present invention may be intensively arranged in a predetermined region of the display.

Figure 4:
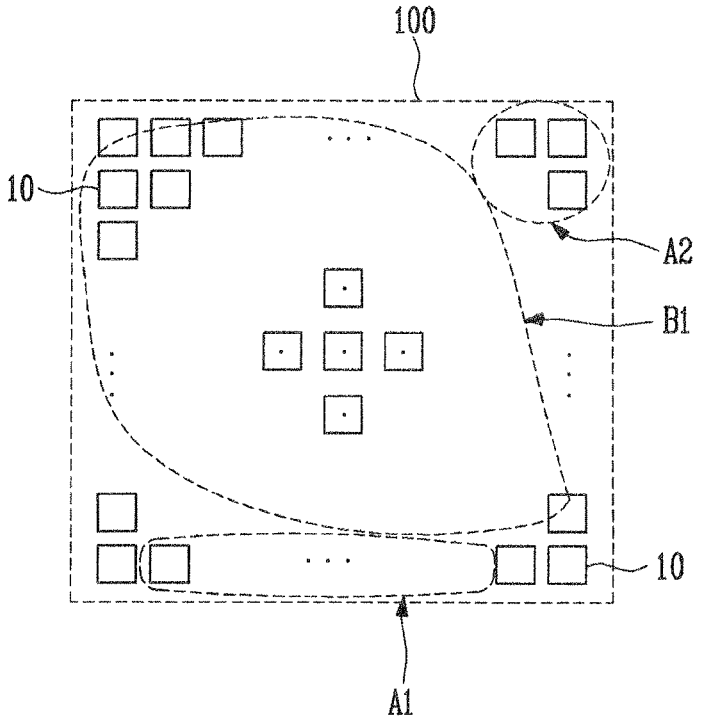
FIG. 4 is a plan view of a display unit illustrating an organic light emitting display according to an embodiment of the present invention.
Figure 5A:
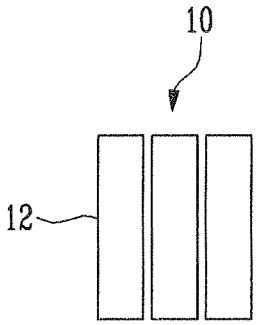
FIGS. 5A and 5B are plan views of a pixel for describing FIG. 4.
Figure 5B:
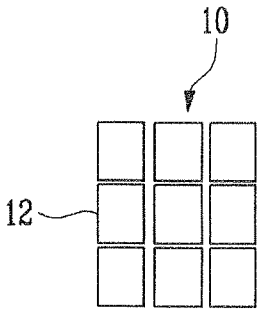

Referring now to FIG. 4, the sub pixels according to the embodiment of the present invention are preferably arranged within a region A1 adjacent to the edge of the display unit 100 or a region A2 adjacent to a corner of the display unit 100. That is, the configuration of the sub pixels 12 (see FIG. 5B) that are arranged within pixels 10 that are arranged within regions A1 and A2 of FIG. 4 are different from the configuration of the sub pixels 12 (see FIG. 5A) that are arranged within pixels 10 that are arranged within region B1 of FIG. 4 and as illustrated in FIG. 5A. Furthermore, the sub pixels 12 arranged within pixels 10 arranged within region B1 and as illustrated in FIG. 5A may all have a same configuration. The term "configuration" is used here to describe the number, the size and the shape of the divisional sub pixels within the sub pixels 12 of a pixel 10 as illustrated by for example in FIGS. 5A and 5B.

According to the embodiment of the present invention, each of the sub pixels 12 that form a partial pixel 10 among the plurality of pixels 10 arranged in a plurality of rows and columns is divided into a plurality of sub pixels, and at least one of the sub pixels 12 includes a plurality of divisional sub pixels that alternately emit light. Since the divisional sub pixels 12-*x* alternately emit light, deterioration speed of the sub pixels is reduced, so that a difference in brightness between the sub pixels 12 having different color may be reduced. In addition, when a pixel is arranged at a location where the same image is continuously displayed, such as a logo, a time, and subtitles of a broadcaster is continuously displayed, it is possible to prevent an afterimage (i.e. image sticking) from being generated due to deterioration of the sub pixels.

In the above embodiments, the pixel 10 of the partial regions A1 and A2 is formed to have the structure of the embodiment described in FIGS. 2A, 2B, and 2C. However, if necessary, all of the pixels 10 throughout the display unit 100 may be formed to have the structure of the embodiment described in FIGS. 2A, 2B, and 2C and still be within the scope of the present invention. For example, should a same image be continuously displayed on the entire display unit 100, the deterioration speed all the pixels 10 may be uniformly reduced.

The embodiments of the present invention can be used to address the problems of image sticking where a same image is being displayed over time, as well as the problem of organic light emitting materials for emitting different color wavelengths deteriorate at different rates over the length of the life of the display. In the displays of the present invention, at least one of the pixels include at least one sub pixel that is divided into a plurality of independently controlled divisional sub pixels. Each sub pixel within a pixel emits light of a different color, and each divisional sub pixel within a sub pixel emits light of a same color. Pixels containing the divisional sub pixels may be arranged only at certain portions of the display that are prone to the image sticking problem, or to an entirety of the display. Furthermore, the divisional sub pixels within a sub pixel can be driven in an alternate manner to prevent deterioration of a display of a particular color. This may be achieved by alternately driving different ones of the divisional sub pixels within a sub pixel according to a frame cycle or a time cycle. Alternately, only ones of the divisional sub pixels may emit light for the first several hundred hours or so of the total operation time of the display, and after this predetermined time, other ones of the divisional sub pixels within a sub pixel may operate, or all of the divisional sub pixels within a sub pixel may then operate in an alternating manner according to a frame cycle or a time cycle. Consequently, the fading of one of the elemental colors with respect to others of the elemental colors over the length of the life of the display can be reduced or eliminated.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display including a first region and a second region, the display comprising:

a plurality of pixels arranged in a plurality of rows and columns throughout the first region and the second region of the display, wherein each of the pixels is composed of one blue sub pixel, one green sub pixel and one red sub pixel, wherein each of the pixels arranged within the first region is comprised of at least one sub pixel that includes a plurality of divisional sub pixels that emit light of a same color and are independently controlled, wherein the pixels arranged within the second region includes none of a sub pixel that includes a plurality of divisional sub pixels of a same color, and wherein each of the divisional sub pixels has a smaller size than each of the plurality of sub pixels.

2. The organic light emitting display of claim 1, and wherein each of the red sub pixel, the green sub pixel, and the blue sub pixel within pixels arranged within the first region of the display is divided into a plurality of divisional sub pixels, wherein the first region is a region adjacent to and along a bottom edge of the plurality of rows and columns corresponding to where a logo, a time and/or subtitles of a broadcaster are continuously displayed.

3. The organic light emitting display of claim 2, wherein each of the red sub pixel, the green sub pixel, and the blue sub pixel within pixels that are arranged within the first region of the display is composed of differing numbers of divisional sub pixels, respectively.

4. The organic light emitting display of claim 2, wherein each of the divisional sub pixels within a sub pixel emit light of a same color and are adapted to be driven in an alternating manner.

5. The organic light emitting display of claim 1, and wherein only the blue sub pixel of pixels arranged within the first region of the display is divided into a plurality of divisional sub pixels.

6. The organic light emitting display of claim 1, wherein the divisional sub pixels within one of the sub pixels within a pixel arranged within the first region of the display alternately emits light.

7. The organic light emitting display of claim 6, wherein the plurality of divisional sub pixels within any one of the sub pixels of a pixel arranged within the first region of the display alternately emits light according to a frame cycle or a time cycle.

8. The organic light emitting display of claim 1, wherein the plurality of divisional sub pixels are alternately driven according to a frame cycle or a time cycle only subsequent to a total operation time of the display exceeding a predetermined value.

9. The organic light emitting display of claim 8, wherein the predetermined value is 300 hours.

10. The organic light emitting display of claim 1, further comprising:

a plurality of scan lines, each being coupled to a plurality of sub pixels in a row; and a plurality of data lines, each being coupled to a plurality of sub pixels in a column, wherein each of the first region and the second region span a plurality of contiguous rows and a plurality of contiguous columns of pixels.

11. The organic light emitting display of claim 10, wherein ones of the plurality of divisional sub pixels within one of the sub pixels of a pixel within the first region emit light of a same color and are independently controlled by being connected to separate signal lines.

12. The organic light emitting display of claim 1, wherein for all of the pixels arranged within the first region, all of the divisional sub pixels within a sub pixel emit a same color of light, and all of the sub pixels within a pixel emit different color light from each other, and each of the divisional sub pixels within a sub pixel being independently controlled, wherein the color of light emitted by the sub pixels are selected from a group consisting of green, red and blue.

13. The organic light emitting display of claim 1, wherein each of the pixels is comprised of a plurality of sub pixels that have a same size and a same shape.

14. The organic light emitting display of claim 13, wherein each of the divisional sub pixels within a sub pixel of a pixel within the first region emits light having a same color, wherein each of the sub pixels within a pixel emits light of a different color from one another, the color being selected from a group consisting of red, green and blue, wherein the display is composed of two contiguous first regions and one contiguous second region.

15. The organic light emitting display of claim 1, wherein only one of the plurality of divisional sub pixels within a sub pixel may emit light prior to a total operation time of the display reaching a predetermined value, and then only another of the plurality of divisional sub pixels within a sub pixel may emit light upon a total operation time of the display exceeding a predetermined value, the predetermined value being 300 hours.

16. An organic light emitting display including a first region and a second region, the display comprising:

a plurality of pixels arranged in a plurality of rows and columns throughout the first region and the second region of the display, wherein each of the pixels is composed of one red sub pixel, one green sub pixel and one blue sub pixel, wherein each of the pixels arranged within the first region is comprised of at least one sub pixel that includes a plurality of divisional sub pixels that emit light of a same color and are independently controlled, wherein the pixels arranged within the second region includes none of a sub pixel that includes a plurality of divisional sub pixels of a same color, wherein the pixels of the first region of the display are intensively arranged in a portion of the display where image sticking occurs most frequently, and wherein each of the divisional sub pixels has a smaller size than each of the plurality of sub pixels.

17. The organic light emitting display of claim 16, wherein the first region is a region adjacent to and along a bottom edge of the plurality of rows and columns corresponding to where a logo, a time and/or subtitles of a broadcaster are continuously displayed.

18. The organic light emitting display of claim 16, wherein the first region is a region adjacent to a corner of the plurality of rows and columns, wherein each of the first region and the second region span a plurality of contiguous rows and a plurality of contiguous columns of pixels.

19. An organic light emitting display including a first region and a second region, the display comprising:

a plurality of pixels arranged in a plurality of rows and columns throughout the first region and the second region of the display, wherein each of the pixels is composed of at least one blue sub pixel, one green sub pixel and one red sub pixel, wherein a configuration of the sub pixels of the pixels arranged within the first region is different from a configuration of the sub pixels of the pixels arranged within the second region, wherein the first region corresponds to only an edge or a corner of the display where a same image is often continuously displayed and is prone to image sticking, and the second region corresponds to remaining portions of the display, wherein each of the blue sub pixel, the green sub pixel and the red sub pixel of each pixel in each of the first and second regions are contiguous and mutually exclusive, and wherein each pixel within the first region includes a sub pixel that includes a plurality of independently controlled divisional sub pixels of a same color, each of the divisional sub pixels having a smaller size than each of the sub pixels within the first region, and wherein the pixels within the second region includes none of a sub pixel that includes more than one divisional sub pixel, wherein the divisional sub pixels within sub pixels of the first region are alternately driven to reduce image sticking, each of the plurality of pixels includes a red sub pixel, a blue sub pixel and a green sub pixel, the display being composed of two contiguous second regions and one contiguous first region, the first region corresponding to a plurality of contiguous rows of pixels and a plurality of contiguous columns of pixels.

* * * * *